US010139064B2

(12) United States Patent
Rizzo

(10) Patent No.: US 10,139,064 B2
(45) Date of Patent: Nov. 27, 2018

(54) LIGHTING COVER ADAPTER FOR GLASS GLOBES

(71) Applicant: Ryden Rizzo, Sea Cliff, NY (US)

(72) Inventor: Ryden Rizzo, Sea Cliff, NY (US)

( * ) Notice: Subject to any disclaimer, the term of this patent is extended or adjusted under 35 U.S.C. 154(b) by 0 days.

(21) Appl. No.: 15/802,426

(22) Filed: Nov. 2, 2017

(65) Prior Publication Data

US 2018/0119909 A1 May 3, 2018

Related U.S. Application Data

(60) Provisional application No. 62/416,328, filed on Nov. 2, 2016.

(51) Int. Cl.

| | |
|---|---|
| ***F21V 17/04*** | (2006.01) |
| ***F21V 3/02*** | (2006.01) |
| ***F21S 8/00*** | (2006.01) |
| ***F21S 8/08*** | (2006.01) |
| ***F21V 3/06*** | (2018.01) |

(52) U.S. Cl.

CPC ..... *F21S 8/088* (2013.01); *F21S 8/00* (2013.01); *F21V 3/02* (2013.01); *F21V 3/061* (2018.02); *F21V 17/04* (2013.01)

(58) Field of Classification Search

CPC .... F21S 8/088; F21S 8/00; F21V 3/02; F21V 3/061; F21V 17/04

See application file for complete search history.

(56) References Cited

U.S. PATENT DOCUMENTS

| | | | | |
|---|---|---|---|---|
| 4,440,467 A * | 4/1984 | Vologni | ..... | H01R 33/22 439/642 |
| 4,719,548 A * | 1/1988 | Orosz | ..... | F21V 3/00 362/309 |
| 4,916,597 A * | 4/1990 | Hallings | ..... | F21V 21/30 362/233 |
| 6,398,397 B1 * | 6/2002 | Koren | ..... | F21S 8/00 362/101 |
| 2004/0017684 A1 * | 1/2004 | Huang | ..... | F21V 19/0005 362/267 |

* cited by examiner

*Primary Examiner* — Donald Raleigh

(57) ABSTRACT

A lighting cover adapter for glass globe covers attaches to a glass globe cover around a bulb receiving opening of the glass globe cover with an internal globe plate and an external globe plate to secure the glass globe cover to a light fixture. A socket adapter is installed around a lightbulb socket. The internal globe plate is inserted through the bulb receiving opening and fastened to the external globe plate outside of the glass globe cover in order to secure the glass globe cover between the internal globe plate and the external globe plate. The glass globe cover is positioned around the lightbulb and the internal globe plate is then secured to the socket adapter through a spacing adapter in order to mount the glass globe cover to the lighting fixture.

15 Claims, 3 Drawing Sheets

LIGHTING COVER ADAPTER FOR GLASS GLOBES

The current application claims a priority to the U.S. Provisional Patent application Ser. No. 62/416,328 filed on Nov. 2, 2016.

FIELD OF THE INVENTION

The present invention relates generally to lighting device adapters. More specifically, the present invention is a threaded adapter for the removal and attachment of glass globe covers around a light socket.

BACKGROUND OF THE INVENTION

Since the inception of electricity as a utility, electrical lighting sources have commonly been implemented for illuminating tasks, aesthetic accents, or ambient applications. Depending on the application, lighting covers are used to focus light emissions, reduce the intensity of light emissions, and/or protect the light bulb from dust or unintended physical contact. One cover commonly used is a glass globe cover. Glass globe covers are typically suspended by a lip of the globe using screws positioned under the lip to secure the globe cover; suspended by wire clip through an opening of the glass globe; or screwed directly into the lighting fixture. Either using screws to suspend or directly screwing the glass globe cover into the light fixture may cause the glass globe cover to fracture if either attachment method is excessively tightened.

The present invention is a lighting cover adapter for glass globe covers. The present invention attaches to a glass globe cover around a bulb receiving opening of the glass globe cover with an internal globe plate and an external globe plate. The internal globe plate is inserted through the bulb receiving opening and fastened to the external globe plate outside of the glass globe cover in order to secure the present invention with the glass globe cover. The internal globe plate is then secured to a socket adapter through a spacing adapter in order to mount the glass globe cover to the lighting fixture.

DETAIL DESCRIPTIONS OF THE INVENTION

All illustrations of the drawings are for the purpose of describing selected versions of the present invention and are not intended to limit the scope of the present invention.

The present invention is a lighting cover adapter for glass globe covers. The present invention attaches to a glass globe cover to facilitate the ease of attachment and removal of the glass globe cover to a lighting fixture. The present invention increases the ease to replace burnt out lightbulbs or to clean the glass globe cover. While the use of this invention is intended for a glass globe cover, the present invention may be adapted for plastic, metal, conical, pyramidal, or any other appropriate combination of shapes and materials for light covers.

Figure 1:
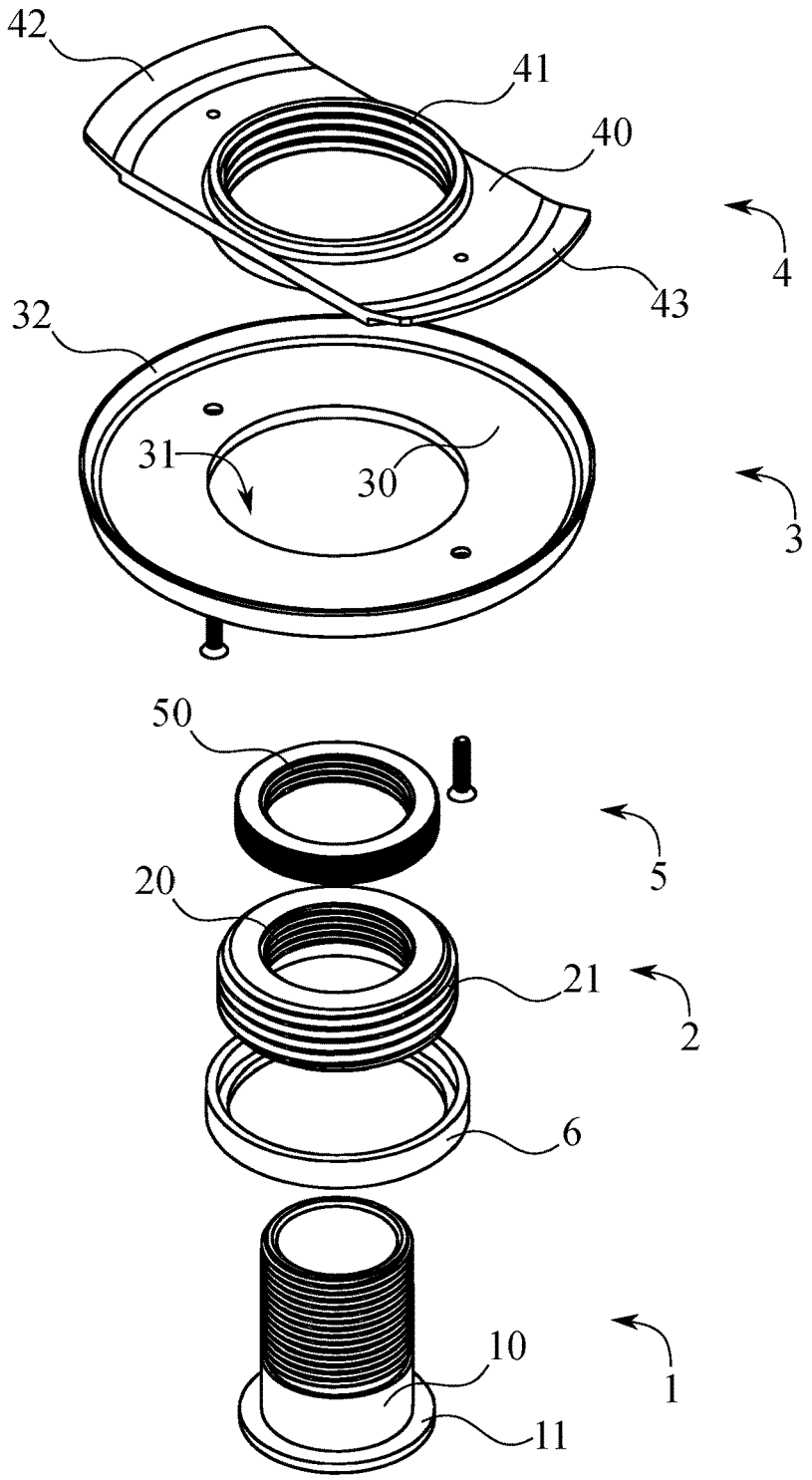
FIG. 1 is an exploded perspective view of the present invention.
Figure 3:
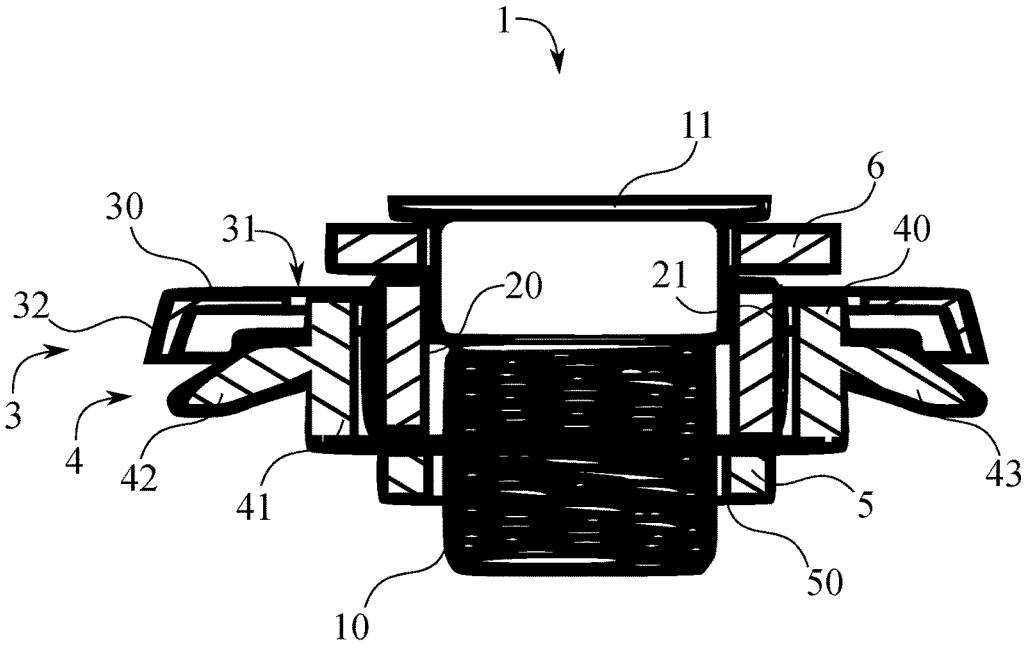
FIG. 3 is a plan view for the present invention as assembled.

In accordance to FIG. 1, the present invention comprises a socket adapter 1, a tubular spacing adapter 2, an external globe plate 3, and an internal globe plate 4. The socket adapter 1 is installed around a lightbulb socket in order to mount the present invention to the lighting fixture. The socket adapter 1 comprises a tubular socket wall 10 and a socket flange 11. The tubular socket wall 10 surrounds the lightbulb socket and the socket flange 11 is mounted to the lighting fixture to support the weight of the present invention and the glass globe cover, as the tubular socket wall 10 is a mounting point for the rest of the present invention. The socket flange 11 is perimetrically and terminally connected to the tubular socket wall 10, such that the socket flange 11 does not interfere with attaching the tubular spacing adapter 2 as the socket flange 11 is mounted to the light fixture. The socket flange 11 provides an extruded portion that engages the light fixture and prevents the present invention from being dislodged from the light fixture. The tubular spacing adapter 2 allows the external globe plate 3 and the internal globe plate 4 to be removed or attached to the tubular socket wall 10, in order to access the lightbulb socket for installation or replacement of the lightbulb. The tubular spacing adapter 2 radially offsets the internal globe plate 4 and the external globe plate 3 from the lightbulb socket in order to allow a lightbulb to be positioned through the internal globe plate 4 and the external globe plate 3 and within the glass globe cover during implementation of the present invention. The tubular socket wall 10 is positioned through the tubular spacing adapter 2, when the glass globe cover is mounted to the present invention. The tubular spacing adapter 2 comprises an interior lateral wall 20 and exterior lateral wall 21. The interior lateral wall 20 engages the tubular socket wall 10 in order to secure the tubular spacing adapter 2 to the socket adapter 1, as shown in FIG. 3. In accordance to the preferred embodiment of the present invention, the interior lateral wall 20 is threadedly engaged with the tubular socket wall 10 to facilitate the ease of removal or attachment of the tubular spacing adapter 2 to the socket adapter 1. The exterior lateral wall 21 provides an attachment point for the internal globe plate 4.

Figure 2:
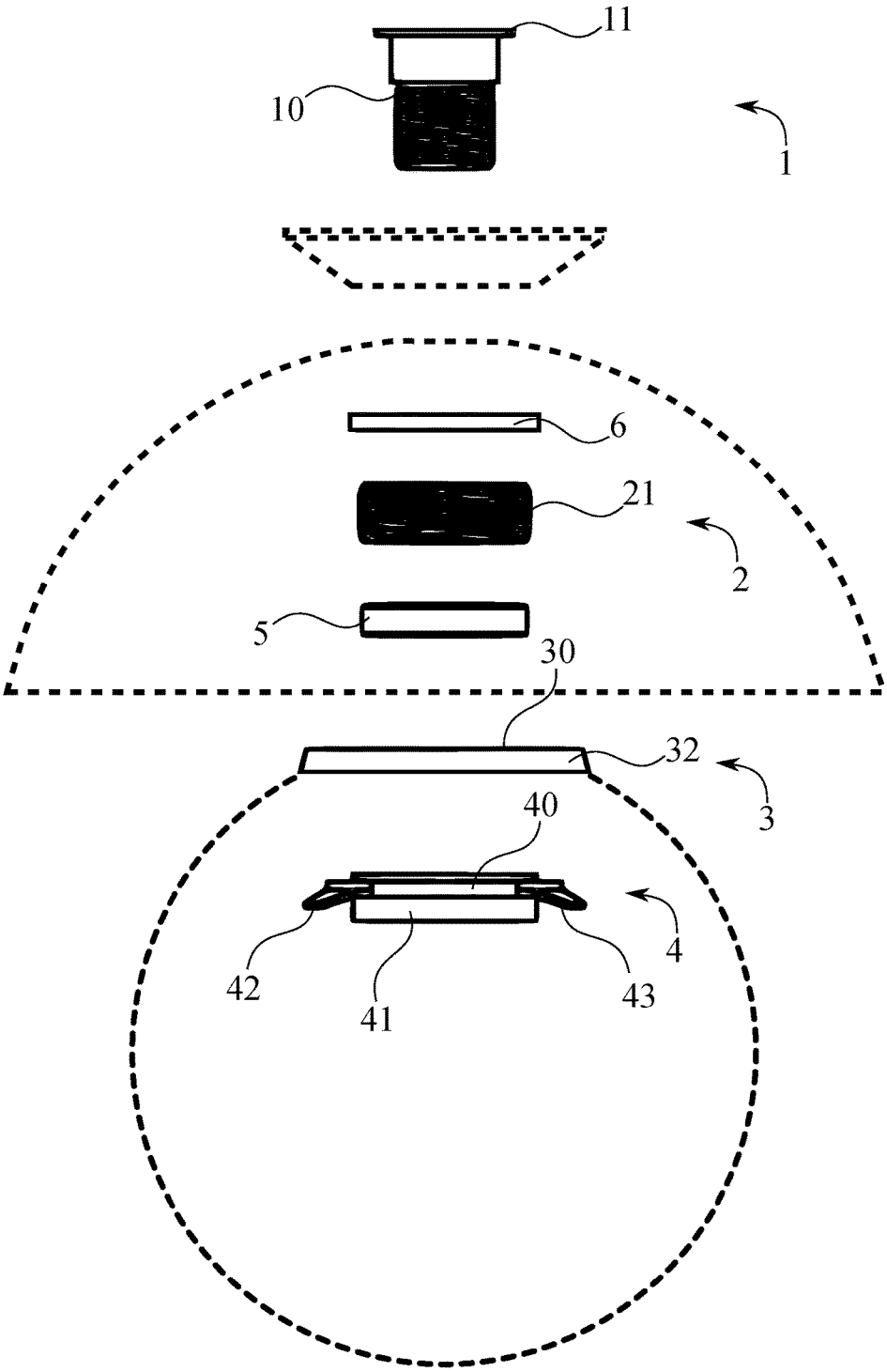
FIG. 2 is an exploded plan view of the present invention as implemented with a lighting fixture and glass globe cover.

The internal globe plate 4 comprises an internal base plate 40 and a tubular base attachment 41, show in FIG. 1. The internal base plate 40 interfaces with the interior of the glass globe cover around the globe opening to support the glass glove cover onto the present invention, as shown in FIG. 2. The tubular base attachment 41 is aligned with the globe opening and secures the internal globe plate 4 to the tubular spacing adapter 2. The tubular base attachment 41 is centrally integrated into the internal base plate 40, in order to evenly support the weight of the glass globe cover and to allow the internal base plate 40 to revolve evenly about a center line of the tubular base attachment 41. The external globe plate 3 comprises an external base plate 30 and an internal plate receiving hole 31. The external globe plate 3 interfaces with the exterior of the glass globe cover around the globe opening to support the glass globe cover onto the present invention through compression with the internal globe plate 4. The internal plate receiving hole 31 centrally traverses through the external base plate 30 to receive the tubular base attachment 41. The tubular base attachment 41 is positioned within the internal plate receiving hole 31 and the external base plate 30 is removably fastened to the internal base plate 40. The external base plate 30 is fastened to the internal base plate 40 through the globe opening such that the fasteners do not traverse through the glass glove cover. Fasteners may include, but are not limited to, screws, magnets, hook and loop fasteners or any other appropriate means of fastening. This configuration secures the internal base plate 40 and the external base plate 30 around the opening of the glass globe cover. The diameter of the tubular base attachment 41 is preferred to be large enough to accommodate the diameter of a lightbulb. The tubular base attachment 41 engages the exterior lateral wall 21 in order to secure the internal base plate 40 and the external base plate 30 to the light fixture, detailed in FIG. 3. In accordance to the preferred embodiment of the present invention, the tubular base attachment 41 is threadedly engaged with the exterior lateral wall 21 to facilitate the ease of removal or attachment of the internal base plate 40 to the tubular spacing adapter 2. The external globe plate 3 is positioned between the internal globe plate 4 and the socket flange 11, wherein the external globe plate 3 offsets the glass globe cover from the lightbulb socket during implementation of the present invention.

In some embodiments of the present invention, the present invention comprises a locking ring 5, detailed in FIG. 1 and FIG. 2. The locking ring 5 comprises an interior ring wall 50 to interface with the tubular socket wall 10. The tubular socket wall 10 is positioned within the locking ring 5. The interior ring wall 50 engages the tubular socket wall 10, shown in FIG. 3. The tubular spacing adapter 2 is positioned between the locking ring 5 and the socket flange 11. The locking ring 5 resists torsional forces from a user removing or attaching the internal base plate 40 to the tubular spacing adapter 2 that may move the tubular spacing adapter 2 along the tubular socket wall 10, therefore securing the tubular spacing adapter 2 on the tubular socket wall 10.

In some other embodiments the present invention comprises a spacing washer 6, shown in FIG. 1 and FIG. 2. The spacing washer 6 protects the socket flange 11 and prevents the tubular spacing adapter 2 from being in direct contact with the socket flange 11. The tubular socket wall 10 is positioned through the spacing washer 6. The spacing washer 6 is pressed between the tubular spacing adapter 2 and the socket flange 11 in order to distribute the force on the socket flange 11 from the engagement between the tubular socket wall 10 and the tubular spacing adapter 2.

For a more specific embodiment of the present invention, the external globe plate 3 is preferred to further comprise an external support extrusion 32, in accordance to FIG. 1 and FIG. 2. The external support extrusion 32 provides additional points of contact with the glass globe cover to secure the glass globe cover between the internal base plate 40 and the external base plate 30. The external support extrusion 32 is perimetrically connected to the external base plate 30. The external support extrusion 32 is oriented towards the internal base plate 40 and is contoured to establish contact with the glass globe cover along the curvature of the glass globe cover.

The internal globe plate 4 further comprises a first internal support extrusion 42 and a second internal support extrusion 43, shown in FIG. 1 and FIG. 2. The first internal support extrusion 42 and the second internal support extrusion 43 provide additional surface area for the glass globe cover to rest on. The first internal support extrusion 42 and the second internal support extrusion 43 are connected to the internal base plate 40. The first internal support extrusion 42 and the second internal support extrusion 43 are diametrically opposed to each other about the tubular base attachment 41, in order to distribute the weight of the glass globe cover across a larger surface area. The first internal support extrusion 42 and the second internal support extrusion 43 are oriented away from the external base in order to accommodate the curvature of the glass globe cover Although the invention has been explained in relation to its preferred embodiment, it is to be understood that many other possible modifications and variations can be made without departing from the spirit and scope of the invention as hereinafter claimed.

What is claimed is:

1. A lighting cover adapter for glass globes comprises:
- a socket adapter;
- a tubular spacing adapter;
- an external globe plate;
- an internal globe plate;
- the socket adapter comprises a tubular socket wall and a socket flange;
- the tubular spacing adapter comprises an interior lateral wall and exterior lateral wall;
- the internal globe plate comprises an internal base plate and a tubular base attachment;
- the external globe plate comprises an external base plate and an internal plate receiving hole;
- the socket flange being perimetrically and terminally connected to the tubular socket wall;
- the tubular socket wall being positioned through the tubular spacing adapter;
- the interior lateral wall engaging the tubular socket wall;
- the tubular base attachment being centrally integrated into the internal base plate;
- the internal plate receiving hole centrally traversing through the external base plate;
- the tubular base attachment being positioned within the internal plate receiving hole;
- the external base plate being removably fastened to the internal base plate;
- the tubular spacing adapter being positioned within the tubular base attachment;
- the tubular base attachment engaging the exterior lateral wall; and
- the external globe plate being positioned between the internal globe plate and the socket flange.

2. The lighting cover adapter for glass globes, as claimed in claim 1, comprises:
- the interior lateral wall being threadedly engaged with the tubular socket wall; and
- the tubular base attachment being threadedly engaged with the exterior lateral wall.

3. The lighting cover adapter for glass globes, as claimed in claim 1, comprises:
- a locking ring;
- the locking ring comprises an interior ring wall;
- the tubular socket wall being positioned within the locking ring;
- the interior ring wall engaging the tubular socket wall; and
- the tubular spacing adapter being positioned between the locking ring and the socket flange.

4. The lighting cover adapter for glass globes, as claimed in claim 1, comprises:
- a spacing washer;
- the tubular socket wall being positioned within spacing washer; and
- the spacing washer being pressed between the tubular spacing adapter and the socket flange.

5. The lighting cover adapter for glass globes, as claimed in claim 1, comprises:
- the external globe plate further comprises an external support extrusion; and the external support extrusion being perimetrically connected around the external base plate.

6. The lighting cover adapter for glass globes, as claimed in claim 5, comprises:

the external support extrusion being oriented towards the internal base plate.

7. The lighting cover adapter for glass globes, as claimed in claim 1, comprises:

the internal globe plate further comprises a first internal support extrusion and a second internal support extrusion;

the first internal support extrusion and the second internal support extrusion being connected to the internal base plate; and the first internal support extrusion and the second internal support extrusion being diametrically opposed to each other about the tubular base attachment.

8. The lighting cover adapter for glass globes, as claimed in claim 7, comprises:

the first internal support extrusion and the second internal support extrusion being oriented away from the external base plate.

9. A lighting cover adapter for glass globes comprises:

a socket adapter;

a tubular spacing adapter;

an external globe plate;

an internal globe plate;

a spacing washer;

the socket adapter comprises a tubular socket wall and a socket flange;

the tubular spacing adapter comprises an interior lateral wall and exterior lateral wall;

the internal globe plate comprises an internal base plate and a tubular base attachment;

the external globe plate comprises an external base plate and an internal plate receiving hole;

the socket flange being perimetrically and terminally connected to the tubular socket wall;

the tubular socket wall being positioned through the tubular spacing adapter;

the interior lateral wall engaging the tubular socket wall;

the tubular base attachment being centrally integrated into the internal base plate;

the internal plate receiving hole centrally traversing through the external base plate;

the tubular base attachment being positioned within the internal plate receiving hole;

the external base plate being removably fastened to the internal base plate;

the tubular spacing adapter being positioned within the tubular base attachment;

the tubular base attachment engaging the exterior lateral wall;

the external globe plate being positioned between the internal globe plate and the socket flange;

the tubular socket wall being positioned within spacing washer; and the spacing washer being pressed between the tubular spacing adapter and the socket flange.

10. The lighting cover adapter for glass globes, as claimed in claim 9, comprises:

the interior lateral wall being threadedly engaged with the tubular socket wall; and the tubular base attachment being threadedly engaged with the exterior lateral wall.

11. The lighting cover adapter for glass globes, as claimed in claim 9, comprises:

a locking ring;

the locking ring comprises an interior ring wall;

the tubular socket wall being positioned within the locking ring;

the interior ring wall engaging the tubular socket wall; and the tubular spacing adapter being positioned between the locking ring and the socket flange.

12. The lighting cover adapter for glass globes, as claimed in claim 9, comprises:

the external globe plate further comprises an external support extrusion; and the external support extrusion being perimetrically connected around the external base plate.

13. The lighting cover adapter for glass globes, as claimed in claim 12, comprises:

the external support extrusion being oriented towards the internal base plate.

14. The lighting cover adapter for glass globes, as claimed in claim 9, comprises:

the internal globe plate further comprises a first internal support extrusion and a second internal support extrusion;

the first internal support extrusion and the second internal support extrusion being connected to the internal base plate; and the first internal support extrusion and the second internal support extrusion being diametrically opposed to each other about the tubular base attachment.

15. The lighting cover adapter for glass globes, as claimed in claim 14, comprises:

the first internal support extrusion and the second internal support extrusion being oriented away from the external base plate.

* * * * *